United States Patent [19]

Sakmann

[11] 4,425,846

[45] Jan. 17, 1984

[54] TYPE BAND AND BAND PRINTER WITH AUTOMATIC PRINT BAND RECOGNITION

[75] Inventor: Walter H. Sakmann, Herrenberg, Fed. Rep. of Germany

[73] Assignee: International Business Machines Corporation, Armonk, N.Y.

[21] Appl. No.: 335,945

[22] Filed: Dec. 30, 1981

[30] Foreign Application Priority Data

Aug. 6, 1981 [EP] European Pat. Off. ..... 81106152.2

[51] Int. Cl.[3] ..... B41J 1/20

[52] U.S. Cl. ..... 101/111; 101/93.14; 400/175

[58] Field of Search ..... 101/93.14, 111; 400/144.2, 144.3, 175

[56] References Cited

U.S. PATENT DOCUMENTS

| | | | |
|---|---|---|---|
| 3,605,610 | 9/1971 | McDonell et al. | 101/111 X |
| 3,845,709 | 11/1974 | Gardiner | 101/93.14 |
| 3,880,075 | 4/1975 | Bavett et al. | 101/111 |
| 3,899,968 | 8/1975 | McDevitt | 101/111 |
| 4,064,800 | 12/1977 | Paccione et al. | 101/111 X |
| 4,074,798 | 2/1978 | Berger | 400/144.3 |

FOREIGN PATENT DOCUMENTS

| | | | |
|---|---|---|---|
| 55-32602 | 3/1980 | Japan | 101/111 |
| 55-74881 | 6/1980 | Japan | 101/93.14 |

*Primary Examiner*—Edward M. Coven
*Attorney, Agent, or Firm*—James E. Murray

[57] ABSTRACT

A type band for a steel band printer containing a track of sensible timing marks is provided with two additional sensible marks each located between two timing marks. The printer counts the number of sensible timing marks occurring between the two additional marks to identify the character set on the type band.

5 Claims, 11 Drawing Figures

T1
40
40
50
40
40
40
40
40
40
40
40
40
40
60
40
40
T2
<T2
<T2
T2
500
600
700

TYPE BAND AND BAND PRINTER WITH AUTOMATIC PRINT BAND RECOGNITION

BACKGROUND

The present invention relates to band printers containing a rotating exchangeable type carrier with sensible timing marks and with a sensible mark to determine the start of control processes for character generation.

The IBM Model 3262 steel band printer uses rotating type bands with etched characters and timing marks. A stationary sensor is used to detect the timing marks on the rotating band and the number of pulses produced during the sensing are counted relative to a pulse produced by a starting mark to identify the character in the print position. In the 3262 printer, the starting mark is a missing timing mark, so that the sensing of the starting mark is accomplished concurrently with the sensing of the timing marks.

The type bands of a steel band printer are exchangeable, so that bands with different character sets can be used and old bands can be replaced by new ones. Data as to the particular kind of type band being used must be entered into the printer before the printer can be properly operated.

In the IBM model 3262 printer, type band identification is effected by a manual procedure. After the type band has been inserted in the printer a sample print-out is made which permits a visual identification of the type band. Then a switch is manually activated to identify the type band to the electronics of the printer system.

This kind of type band identification is time consuming, complex and unreliable.

German patent application OS No. 25 00 263 shows a printer system with an automatic type band identification system. The type band has a binary-encoded band identification mark arranged on a separate track from the timing signals. This arrangement is complex, since it requires an additional marker track and an additional sensor and amplifier.

THE INVENTION

In accordance with the present invention a new self-actualizing type band identification system is provided. Each different kind of type band is identified by a unique spacing of two additional non-timing sense marks in its timing mark string. The printer counts the number of timing marks between the two additional non-timing marks to identify the particular type band on the printer.

Therefore, an object of the invention is to provide means for type carrier band recognition.

Another object of the invention is to provide a simple means for automatically identifying the type band in a printer.

DESCRIPTION OF THE DRAWINGS

These and other objects of the invention can best be understood by reference to a detailed description of an embodiment of the invention shown in the accompanying drawings of which.

DETAILED DESCRIPTION

Figure 1:
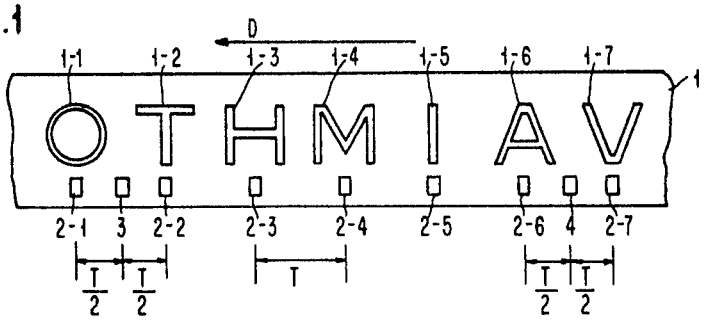
FIG. 1 is a schematic sectional view of a type band with characters, timing marks, and a start and identification mark.

As shown in FIG. 1, type carrier band 1 has been photo chemically etched to provide raised characters 1-1 to 1-7 and timing marks 2-1 to 2-7. In accordance with the present invention both a start mark 3 and an identification mark 4 are included in the timing mark sensing string to provide the printer with information as to the kind of type band on the printer.

Figure 2:
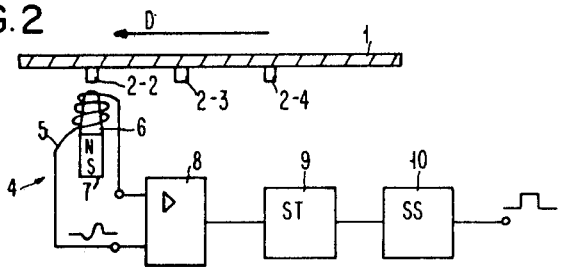
FIG. 2 is a schematic containing a sectional view of the type band in combination with a sensor for the timing marks.

As shown in FIG. 2 the type carrier band 1 moves in the direction D so that with its timing marks 2-2, 2-3, etc. move past a sensor. This sensor consists of a permanent magnet 7 with a soft iron tip 6 with a coil 5 around it.

When a timing mark, e.g. 2-2, moves past the sensor tip 4, the reluctance is reduced in a flux path which extends from permanent magnet 7 and soft iron tip 6 through the air and timing mark 2-2. The reluctance change in this path induces an electrical pulse P in coil 5. Thus, as the print band 1 moves past the sensor, there will be a sequence of pulses one for each of the passing timing marks and start or identification marks.

The start mark 3 is positioned between timing marks 2-1 and 2-2 while the identification mark 4 is located between two other adjacent timing marks 2-6 and 2-7. The distance between start mark 3 and identification mark 4 is defined by the number of timing marks between them. This number of timing marks between marks 3 and 4 identifies the print band to the printer. It is used for the program-controlled addressing of a storage location at which the type band information required for print control of the inserted type band is stored.

In the case of other type bands with different kinds of type or alphabets, the identification mark 4 will occur at another spot, in the timing string, relative to the start mark so that each different type band is defined by a different count between the start and identification marks.

In order to prevent misunderstandings it is pointed out explicitly that identical type bands have the same identifying count.

Type band identification is executed at each start of the printer. The distance T on the type band between each two adjacent timing marks is constant. The distance of start mark 3 and identification mark 4 with respect to each adjacent timing mark is half that or T/2. This difference in distances enables descrimination of the pulses produced by the start and identification marks from those produced by the timing marks.

Figure 3:
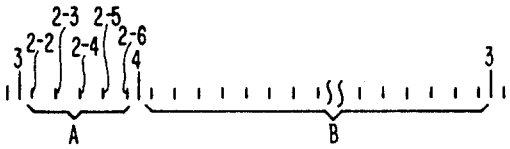
FIG. 3 is a schematic representation as the unrolling of the timing marks to be considered for a band revolution as well as the start and identification mark.

FIG. 3 represents an unrolling of one revolution of timing marks including the start and identification marks. The number of timing marks between start mark 3 and identification mark 4 is A, the number of timing marks between identification mark 4 and start mark 3 is B. As shall be seen the circuitry of FIG. 5 counts the numbers A and B in two different counters and the smaller count is used for band identification. Upon the first occurrence of a "non-timing mark" (mark 3 or 4) it is not evident whether the start or the identification mark is being sensed. The start mark is therefore defined as that non-timing mark 3 or 4 which is followed by the number of the subsequent timing marks totaling less than ½ the total number of all timing marks A and B. Consequently, the total number of different type bands that can be identified by this embodiment is limited to ½ (A+B)−1.

Figures 4A, 4B, 4C, 4D, 4E, 4F, 4G:
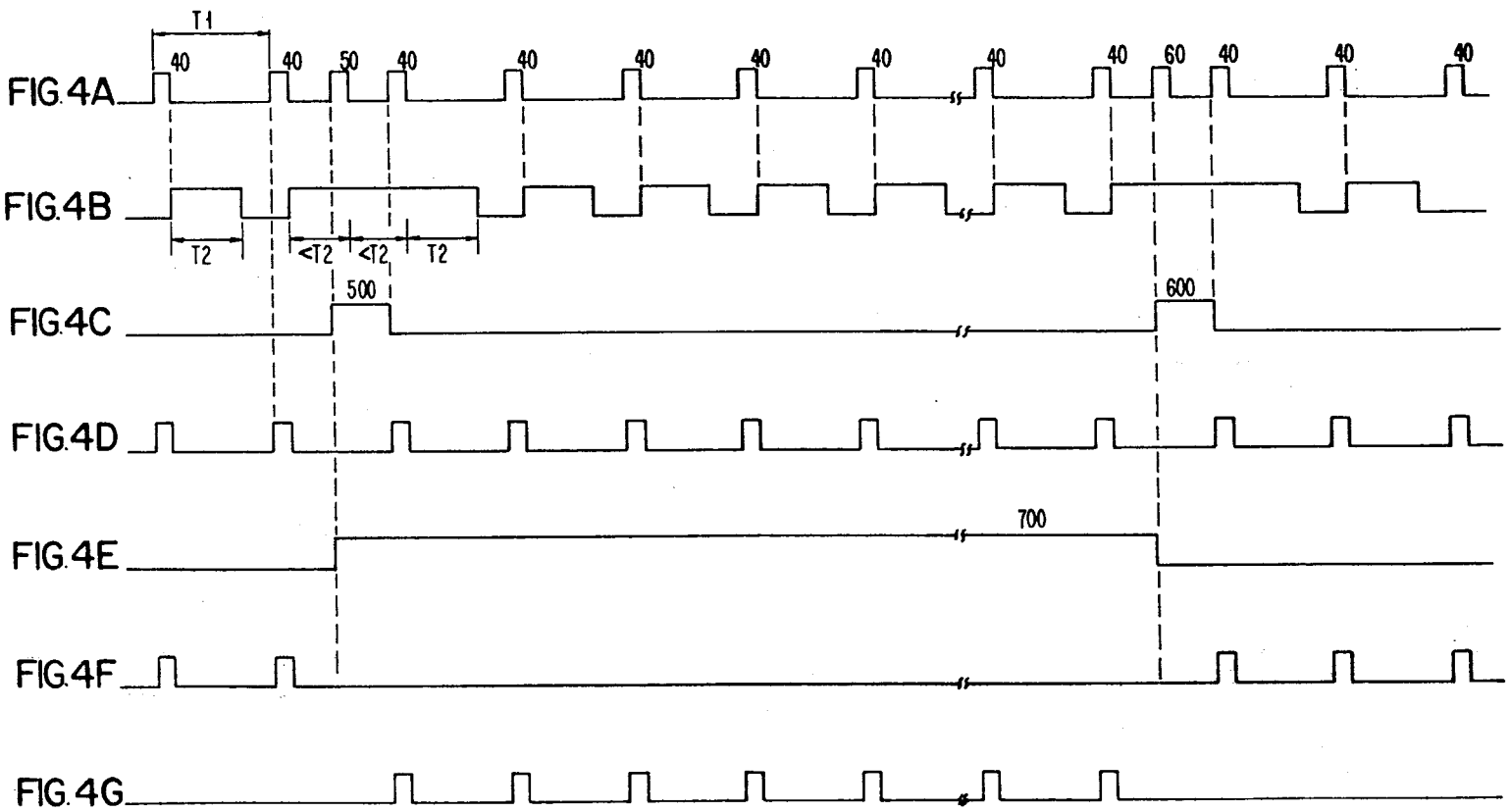
FIGS. 4A to 4G are pulse patterns at different points in the block circuit diagram of FIG. 5.

FIG. 4A shows a number of pulses derived from the sensed timing marks and the sensed start and identification marks.

FIG. 4B represents a pulse sequence which is obtained by means of a single shot triggered from the pulse sequence according to FIG. 4A.

FIG. 4C shows a pulse sequence obtained by means of a flip-flop FF and ANDing the pulse sequences of FIG. 4A and FIG. 4B.

FIG. 4D shows a filtered pulse sequence with only those pulses which are derived from the timing marks (the pulses derived from the start mark and the identification mark are excluded in the pulse diagram).

FIG. 4E shows the signal course as derived from that of FIG. 4C. The leading edges of pulses 500 and 600 determine the duration of pulse 700. The signal in diagram 4E is thus characterized by a signal absence region and a signal presence region. The signal according to FIG. 4E is used for controlling two counters. The first counter records the filtered timing mark pulses (according to FIG. 4D) during the signal absence time in FIG. 4E (see FIG. 4F); the other counters is used for counting the filtered timer mark pulses during the signal presence time in FIG. 4E (see FIG. 4G).

The signals at sensor 4 have a form as the one given in the drawings. They are amplified by differential amplifier 8 and entered in a Schmitt trigger 9 which shapes them into a sequence of rectangular pulses. The width of these pulses is determined by the Schmitt trigger. These pulses are transformed into the sequence of rectangular pulses shown in FIG. 4A, by single shot 10. Single shot 10 is triggered by the leading edge of the Schmitt trigger output pulses.

Figure 5:
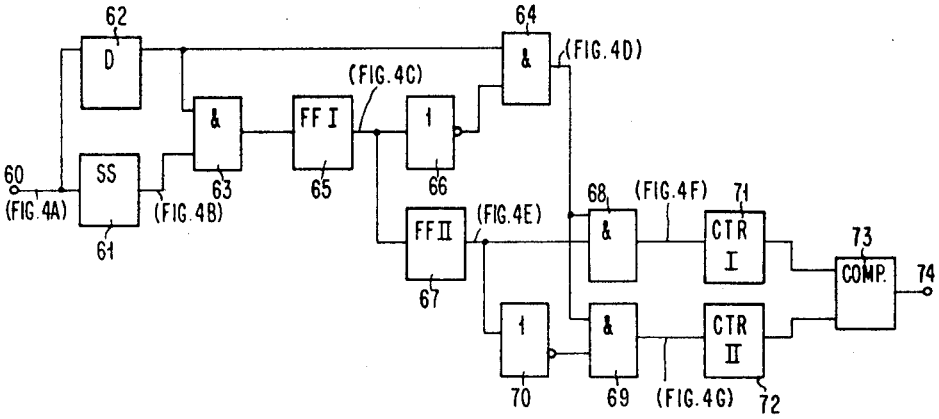
FIG. 5 is a schematic block circuit diagram for electronically filtering out the pulses produced by the start and identification marks and to provide a count for type band identification.

FIG. 5 shows the block diagram of a circuit that can be used for automatically determining the band recognition. This circuit receives the pulse sequence of FIG. 4A which contains timing mark pulses 40 as well as start mark pulse 50 and identification mark pulse 60. This pulse sequence is applied on one side to a re-triggerable, single shot 61, and on the other side to a delay unit 62. The single shot's output signal is set by the trailing edge of pulse 40 and remains up for a time $T_2$. Time $T_2$, including the pulse width of pulses 40, is approximately 75% of time $T_1$ which is the pulse period of pulses 40 in FIG. 4A.

As start mark pulse 50 and identification mark pulse 60 are in the middle between two respective adjacent pulses, their trailing edge occur before the single shot 61 times out. Therefore, the output of the single shot remains up for 1.75 T. The same is true when the identification mark comes up. This is shown in FIG. 4B.

The output of single shot 61, and the output of delay unit 62 are both applied to an AND circuit 63 whose output is again fed to a bistable flip-flop 65. This circuit filters the start mark and identification mark pulses out of the signal sequence of FIG. 4A. When output signal of single shot 61, and leading edge of pulse 50 occur simultaneously, a signal is generated at the output of AND gate 63 which sets a flip-flop 65. This flip-flop 65 is reset by the subsequent output signal at AND circuit 63 formed by an output signal of the single shot and by a simultaneously present leading edge of a pulse 60. In this manner, flip-flop 65 produces output signals 500, 600 shown in FIG. 4C. The function of the delay unit 62 is to delay the pulses of FIG. 4A slightly to ensure spikeless operation of the AND function in AND circuit 63. For purposes of simplicity this delay function was not incorporated into the pulse diagrams of FIG. 4.

The output of bistable flip-flop FFI 65 is applied through a negator 66 to an AND circuit 64 which receives a second input from delay unit 62. The function of this is to filter pulses 50 and 60 out of the pulse sequence of FIG. A leaving only the timing mark pulses shown in FIG. 4D.

The pulses sequence of FIG. 4A is thus divided into two different pulses sequences, one (FIG. 4D) containing the timer mark pulses, and the other (FIG. 4C) flip-flop pulses 500 and 600 corresponding to the start and identification mark pulses.

The counting processes can be controlled using the signal sequences of FIGS. 4C and 4D to determine the counts A and B mentioned in connection with FIG. 3. For that purpose, the output signal of AND circuit 64 is applied to AND circuits 68 and 69. The second input of AND circuit 68 is connected through a flip-flop FFII 67 to the output of flip-flop FFI 65, while the second input of AND gate 69 is connected via a negator 70 to the output of flip-flop FFII 67. The pulse sequence of FIG. 4C is used by flip-flop 69 to generate the sequence shown in FIG. 4E. Flip-flop 67 thus supplies an output signal for the period from the leading edge of the first output signal 500 of flip-flop 65 to the leading edge of the subsequent output signal 600 of flip-flop 65. During this period, the filtered timing mark pulses shown in FIG. 4D can pass AND gate 68 to be counted in a counter CTR I 71. During the time which an output signal of flip-flop 67 is down inverter 70's output enables AND circuit 69 to count the timing mark pulses of sequence FIG. 4D in CTR II 72. Both counters 71 and 72 are connected to a comparator 73 for determining the lower count, with the output 74 of said comparator supplying the lower count as the type band identification number.

The above circuit for type band recognition shown in FIG. 6 is only one embodiment of the invention. Other circuits for filtering out the start mark and identification mark pulses will be apparent to those skilled in the art. For instance, it is possible to use an identification mark pulses which would be the absence of a timing mark. In this case, the continuance of the sequence of the timing marks on the type band would be missing a timing mark at the location of the start mark and/or the band type mark.

Therefore, it should be understood that any number of changes can be made in the described embodiment by those skilled in the art without departing from the spirit and scope of the invention as set forth in the claims.

Having thus described my invention, what I claim as new, and desire to secure by Letters Patent is:

1. In a rotating exchangeable type character carrier for impact printers capable of operating with a number of different type character carriers where there is a track of equally spaced sensible timing marks associated with the characters which track contains a first sensible non-timing mark positioned between two of the equally spaced timing marks to identify a start point for control processes of the impact printers, the improvement comprising:

a second sensible non-timing mark in said track that is uniquely spaced from the first non-timing mark for each of the different type character carriers between two of the equally spaced timing marks so that the number of timing marks occurring on the track between the first and second sensible non-timing marks uniquely identifies each type character carrier.

2. The type character carrier claims in claim 1, wherein the first and second non-timing marks are even positioned half-way between timing marks, in a track of equally spaced timing marks.

3. In combination with the character carrier of claim 1, an impact printer including means for sensing the timing marks and the first and second non-timing marks and means for counting the timing marks occurring between said first and second non-timing marks.

4. The combination of claim 3 wherein said means for counting said timing marks includes means for keeping two counts one count of timing pulses occurring between the first and second occurence of a non-timing pulse and the second count of timing pulses occurring between the second and third occurrence of a non-timing pulse.

5. The combination of claim 4 including means for selecting the lower of the two counts as the count to identify the particular type character carrier.

* * * * *